US010124463B2

(12) United States Patent
Alles

(10) Patent No.: US 10,124,463 B2
(45) Date of Patent: Nov. 13, 2018

(54) SANDING PAD

(71) Applicant: JOHNNY BLOX, LLC, Lake Ozark, MO (US)

(72) Inventor: John Alles, Lake Ozark, MO (US)

(73) Assignee: Johnny Blox, LLC, Lake Ozark, MO (US)

( * ) Notice: Subject to any disclaimer, the term of this patent is extended or adjusted under 35 U.S.C. 154(b) by 71 days.

(21) Appl. No.: 15/009,354

(22) Filed: Jan. 28, 2016

(65) Prior Publication Data

US 2016/0221144 A1 Aug. 4, 2016

Related U.S. Application Data

(60) Provisional application No. 62/111,423, filed on Feb. 3, 2015.

(51) Int. Cl.
*B24B 37/20* (2012.01)
*B24B 37/22* (2012.01)

(52) U.S. Cl.
CPC ..... *B24B 37/22* (2013.01)

(58) Field of Classification Search
CPC ..... B24B 37/22; B24D 9/085; B24D 11/00; B29C 43/222; B29C 55/06; A44B 18/00
USPC ..... 451/528–539
See application file for complete search history.

(56) References Cited

U.S. PATENT DOCUMENTS 1,562,414 A 11/1925 McKnight
1,934,139 A * 11/1933 Pavitt ..... B24D 15/105 451/556
2,156,492 A * 5/1939 Davis ..... B24D 11/00 451/533
2,414,036 A * 1/1947 Gerhan ..... B24D 15/04 451/512
2,417,680 A * 3/1947 Decker ..... B24D 15/04 451/510
2,485,295 A * 10/1949 Larson ..... B24D 11/00 206/447
2,644,280 A * 7/1953 O'Neil, Jr. ..... B24D 9/08 428/316.6
2,650,158 A * 8/1953 Eastman ..... A47L 13/16 15/229.11
2,722,790 A * 11/1955 Smith ..... A47L 11/12 451/356
2,732,065 A * 1/1956 Marchese ..... A43C 15/02 152/208

(Continued)

OTHER PUBLICATIONS

Plastic World, Two components PUR for flexible parts, Feb. 1986.*

(Continued)

*Primary Examiner* — George Nguyen
(74) *Attorney, Agent, or Firm* — Lathrop Gage L.L.P.

(57) ABSTRACT

Sanding pads are disclosed. A sanding pad has at least about 1/32 inch thickness, having one top flat surface and an opposite flat bottom surface. The top and bottom surfaces are capable of providing attachment for an abrasive material, such as a pressure adhesive sand paper. The sanding pad is formed of various geometric shapes and made from an expanded PVT material which has a Shore D durometer hardness value between 30 and 60. The sanding pad comes in a kit that includes several sanding pads, each of a different shape and situated purpose.

17 Claims, 4 Drawing Sheets

(56) References Cited

U.S. PATENT DOCUMENTS 2,826,014 A * 3/1958 Field ..... B24D 9/00 451/512
2,889,667 A * 6/1959 Campbell ..... B24D 15/04 15/118
3,247,626 A * 4/1966 Kunkle ..... B24B 7/241 451/261
3,267,623 A * 8/1966 Block ..... B24D 11/008 206/445
3,333,371 A * 8/1967 Pratt ..... B24D 9/08 451/490
3,377,151 A * 4/1968 Lanham ..... A47L 17/08 451/532
3,418,675 A * 12/1968 Meguiar ..... B24D 13/147 15/230
3,732,652 A * 5/1973 Furgal ..... A47L 13/18 401/196
3,849,949 A * 11/1974 Steinhauser ..... B24D 11/008 225/38
3,875,703 A * 4/1975 Clemente ..... B24D 11/00 451/359
4,055,897 A 11/1977 Brix
4,202,139 A 5/1980 Hong et al.
4,380,092 A * 4/1983 Brothers ..... A47L 11/12 15/229.12
4,427,111 A * 1/1984 Laipply ..... A47K 10/16 206/210
4,558,542 A * 12/1985 Marton ..... B24D 9/085 451/490
4,714,644 A * 12/1987 Rich ..... B24D 15/04 428/136
4,850,502 A * 7/1989 Davis ..... A45C 13/22 16/425
4,887,396 A * 12/1989 Lukianoff ..... B24D 15/04 451/523
5,085,011 A * 2/1992 Smith ..... B24B 9/16 269/119
5,183,479 A * 2/1993 Grimes ..... B24D 11/008 427/240
5,332,098 A 7/1994 Fisher et al.
5,429,545 A * 7/1995 Meyer ..... A47L 13/17 451/523
5,975,999 A 11/1999 Nitta
6,142,868 A * 11/2000 Pfanstiehl ..... B05C 17/00 15/169
6,352,471 B1 * 3/2002 Bange ..... A46B 3/005 451/527
6,428,407 B1 * 8/2002 Elder ..... B24D 11/00 283/101
6,488,574 B1 * 12/2002 Calafut ..... A45D 29/04 132/73
7,264,542 B1 * 9/2007 Leyva ..... B24D 15/08 451/494
2001/0002355 A1 * 5/2001 Savant ..... G02B 5/0221 451/38
2002/0102919 A1 * 8/2002 Lalli ..... G11B 23/505 451/41
2002/0197941 A1 * 12/2002 Bruno ..... B24D 13/145 451/360
2003/0109209 A1 * 6/2003 Hishiki ..... B24B 37/24 451/527
2005/0054280 A1 * 3/2005 D'Estais ..... B24D 9/085 451/533
2005/0170765 A1 * 8/2005 Shermer ..... B24B 23/00 451/538
2006/0099889 A1 * 5/2006 Tabata ..... B24B 13/02 451/41
2007/0037500 A1 * 2/2007 Minick ..... B24D 11/008 451/533
2007/0175382 A1 * 8/2007 Warner ..... G01K 1/14 116/216
2007/0176341 A1 * 8/2007 Molitor ..... B60G 11/22 267/292
2008/0020678 A1 * 1/2008 Miekka ..... B24D 15/02 451/28
2008/0085664 A1 * 4/2008 Weiford ..... B24B 7/184 451/259
2008/0233845 A1 * 9/2008 Annen ..... B24B 23/04 451/259
2009/0019803 A1 1/2009 Chapman
2009/0209186 A1 * 8/2009 Krauss ..... B24B 23/03 451/548
2009/0264059 A1 * 10/2009 Zagone ..... B24D 11/00 451/539
2010/0009604 A1 1/2010 Petersen et al.
2010/0130925 A1 * 5/2010 Haslinger ..... A61L 29/041 604/96.01
2010/0210197 A1 * 8/2010 Matsumura et al. ... B24B 37/22 451/526
2010/0330882 A1 * 12/2010 Schwandner ..... B24B 7/22 451/41
2011/0094163 A1 * 4/2011 Russell ..... B24D 3/002 51/297
2011/0318993 A1 * 12/2011 Smith ..... B24B 1/007 451/28
2012/0295525 A1 11/2012 Annen et al.
2012/0309273 A1 * 12/2012 Popov ..... B24D 15/023 451/57
2015/0056898 A1 * 2/2015 Christen ..... B24B 55/10 451/488

OTHER PUBLICATIONS

International Society of Biomechanics XII, A comparison of selected Headforms under Impact Conditions, 1989.*
Tentative Method of Test for Indentation Hardness of Rubber and Plastics by Means of a Durometer, ASTM Designation: D 2240-64 T, Issued, 1964, published in 1965 Book of ASTM Standards, Part 27—Plastics—General Methods of Testing, published Jun. 1965 by American Society for Testing and Materials, pp. 1008-1011 and 695-698.

* cited by examiner

SANDING PAD

CROSS REFERENCE TO RELATED APPLICATIONS

This application claims the benefit of U.S. Provisional Application No. 62/111,423, filed Feb. 2, 2015, the entirety of which is incorporated by reference herein.

BACKGROUND OF THE INVENTION

Sanding pads or coated abrasive sheet materials have many useful applications. One particularly useful application may include sanding vehicle body parts of various geometrical shapes and sizes as a preparation for a paint finish. Several factors may impact the efficiency and adequacy of the sanding block, including the grit size of the sandpaper, the size and shape of the pad, and whether the sandpaper is attached to a backing or tool.

One past method of sanding included a user holding a piece of sandpaper in his hands and rubbing it against the surface to be sanded. Many applications require hand sanding where the user will grasp a coated abrasive sheet in his hand and apply it to the surface being treated. However, this method provides an unreliable sanded product as a result of the variable pressure exerted by the user's hands when sanding the object. Improper positioning will cause uneven abrasion of the treated surface. Irregular pressure, such as caused by the fingers against the back side of the abrasive sheet in use, produces an irregular abraded surface.

Another known method of sanding includes the use of a tool developed to aid in the sanding process. Early holding tools or devices used for this purpose were inflexible blocks of solid material such as wood over which the coated abrasive sheet was wrapped. Later a self-adhering coated abrasive sheet material using pressure-sensitive adhesive coated on its back side was developed, so that, it may be adhered directly to the working face of a sanding block. For the most part, this means of attachment assures exposure of the entire abrasive face of the abrasive sheet. Other tools constructed of soft rubber or flexible materials were developed, but because of the flexibility do not provide a consistently uniform finished product because the material deforms as it contacts raised areas in the product being sanded, often causing a washboard effect, ribs, or ripples in the product. The deficiencies encountered by hand-sanding or using a tool must be corrected by the user spending additional and unnecessary time and effort sanding the uneven portions of the product.

A need therefore exists for a sanding tool that operates to provide a material that is rigid enough to not deform against raised areas, but flexible enough to on low spots to provide a consistent, smooth sanded finish on a product.

BRIEF SUMMARY OF THE INVENTION

Other objects and advantages of this invention will become apparent from the following description taken in conjunction with the accompanying drawings wherein are set forth, by way of illustration and example, certain embodiments of this invention.

The sanding pads are designed to conform to the shape of a particular structure to be sanded or otherwise worked on and designed not to conform to dips or raising projections in the structure to be sanded. They enable smooth professional finishes without washboard effects, as they allow the abrasive material to conform to a particular shape of the structure without the need to add filler or primer. The material of expanded PVC allows for linear thermal expansion up to 140 degrees Fahrenheit to allow for the product to be outdoors without becoming brittle or receiving permanent dimensional damage.

The sanding pad of at least about 1/32 inch thickness has one top flat surface and an opposite flat bottom surface, the top and bottom surfaces being capable of providing attachment for an abrasive material, said pad being formed of a material which has a Shore D durometer hardness value between 30 and 60, or more specifically between 34 and 55. The shore D durometer hardness value could be that of Komatex®, which is between 48 and 55. The sanding pad may also be between 1/8 and 1/4 inch thick. The abrasive material supported by a paper substrate may be attached to the bottom surface of said pad by means of a pressure sensitive adhesive. The abrasive material may be removable. The abrasive material may be wrapped about the sanding pad.

The sanding pad may include a handle permanently attached to the top surface of the pad. The handle may be more than one piece. The sanding pad is adapted to be connected to a driving means or a tool.

The sanding pad may be formed into various geometric shapes and sizes, such as rectangular, semi-circular, circular, square, etc., and may further include at least one cut out along a length thereof. The cut-out may be formed so as to match an outer surface on a structure to be sanded, and therefore meant to service a single purpose.

The sanding pads may be included as part of a sanding kit containing a multiplicity of sanding tools of various shapes, sizes, lengths, and thicknesses.

BRIEF DESCRIPTION OF THE DRAWINGS

The drawings constitute a part of this specification and include exemplary embodiments of the present invention and illustrate various objects and features thereof.

A further understanding of the invention may be had by reference to the accompanying drawing in which.

DETAILED DESCRIPTION OF THE INVENTION

As required, detailed embodiments of the present invention are disclosed herein. However, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. It is also noted that any reference to the words top, bottom, up and down, and the like, in this application refers to the alignment shown in the various drawings, as well as the normal connotations applied to such devices, and is not intended to restrict positioning of the connecting member assemblies of the application and cooperating bone anchors in actual use.

Figure 1:
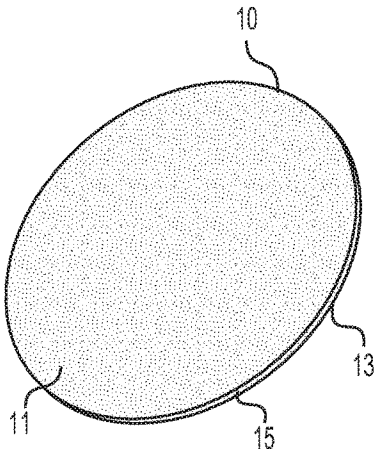
FIG. 1 is a perspective view of the sanding pad of the invention in a first embodiment.
Figure 5:
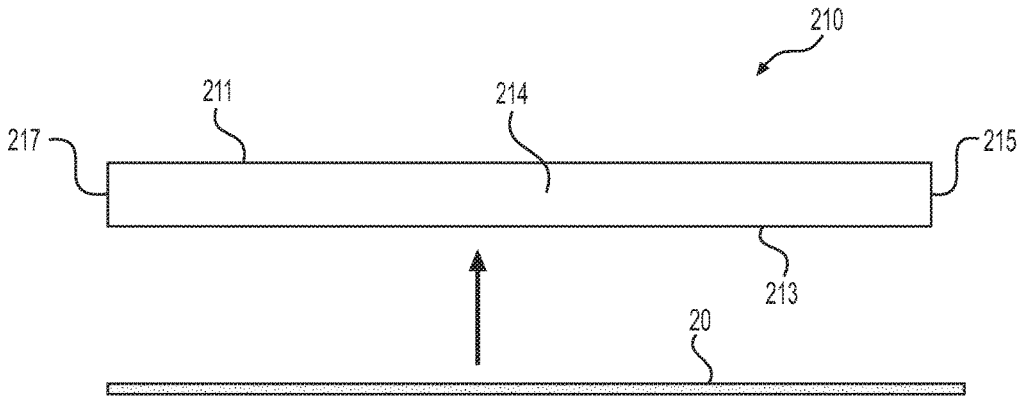
FIG. 5 is an exploded side view of the sanding pad of the invention in the third embodiment in combination with an adhesive sanding material.

Referring to FIG. 1, in one embodiment, a sanding device comprises a sanding pad 10 having two opposed surfaces 11 and 13 and a side surface 15, each capable of receiving abrasive material (FIG. 5).

The sanding pad 10 may be a variety of shapes and sizes depending on the application. For example, as shown in the FIGS. 1-4, the pad may come in various geometric shapes, such as rectangular (FIGS. 3-4), circular (FIG. 1), semi-circular (FIG. 2) shapes, which may allow the pads 10, 110, 210, 310 to be used with tools such as a power sander to which the pads may be attached. It is foreseen that a variety of shapes will be sold as a kit, as each shape may be conformed to a specific task.

Figure 2:
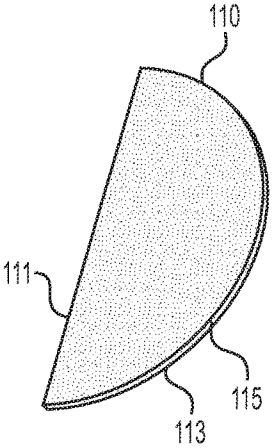
FIG. 2 is a perspective view of the sanding pad of the invention in a second embodiment.

Referring to FIG. 2, in one embodiment, a sanding device comprises a sanding pad 110 having two opposed surfaces 111 and 113 and a side surface 115, each capable of receiving abrasive material (FIG. 5).

Figure 3:
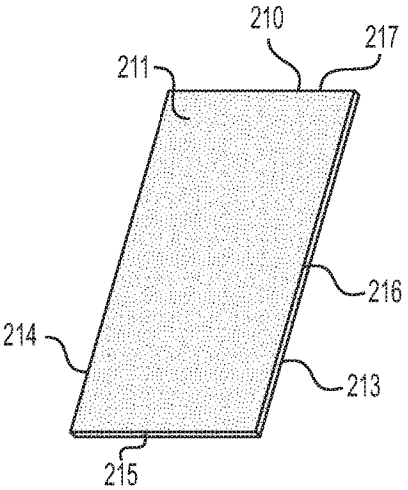
FIG. 3 is a perspective view of the sanding pad of the invention in a third embodiment.

Referring to FIG. 3, in another embodiment, a sanding device comprises a sanding pad 210 having two opposed surfaces 211 and 213 and a side surfaces 214, 215, 216, 217, each capable of receiving abrasive material 20 (FIG. 5).

Figure 4:
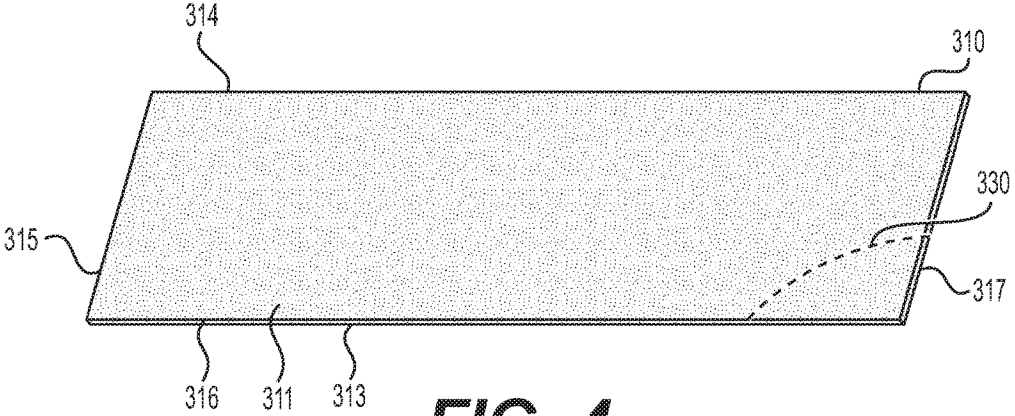
FIG. 4 is a perspective view of the sanding pad of the invention in a fourth embodiment.

Referring to FIG. 4, in another embodiment, a sanding device comprises a sanding pad 310 having two opposed surfaces 311 and 313 and a side surfaces 314, 315, 316, 317, each capable of receiving abrasive material (FIG. 5). The side 316 may further include at least one cut out 330 along a length thereof. The cut-out 330 may be formed so as to match an outer surface on a structure to be sanded, and therefore meant to service a single purpose.

The sanding pad 10, 110, 210, 310 may be made of any appropriate material capable of maintaining its shape while sanding uneven surfaces. In a preferred embodiment, the material may be expanded sheet polyvinyl chloride (PVC). Expanded sheet PVC may be especially useful because of the strength of the material which may prevent the deformation of the material as the sanding pad 10, 110, 210, 310 moves over an uneven surface. In some embodiments, the expanded sheet PVC may have a Shore D durometer hardness value of between about 30 and 60, and more preferably, between 34 and 55. Another example, such as Komatex® material, the Shore D durometer hardness value is between 48 and 55 and the flexural strength between 20 and 30 $N/mm^2$. Softer and more flexible materials tend to bow at contact with raised portions of the surface of the product to be sanded. While this may remove any inconsistencies at the top level of the surface, the raised portions themselves may not be sanded down without significant effort of the user. The result may be a product with an undulating surface, rather than a smooth surface.

In contrast, sanding pad 10, 110, 210, 310 does not bow at contact with inconsistencies in the surface of a product needing sanding. When the sanding pad 10, 110, 210, 310 comes into contact with a raised portion of the surface of a product, the raised portion is sanded down until the surface is perfectly smooth. However, depending on the thickness of the sanding pad 10, 110, 210, 310, the sanding pad 10, 110, 210, 310 may be bent to generally conform to the shape of the product. The thinner the pad, the more it the pad can be bent; the thicker the pad, the less give the material will offer, preventing the pad from bending beyond a minimal amount, if at all. Regardless of the amount of bend in the material, when bent, the expanded sheet PVC may become a perfect arc, thereby allowing curved portions of the product to be sanded. Additionally, the pads 10, 110, 210, 310 may come in a variety of thicknesses in a set of pads, and may be at least 1/32 inch thick, and more preferably, between 1/8 and 1/4 inch thick.

Figure 6:
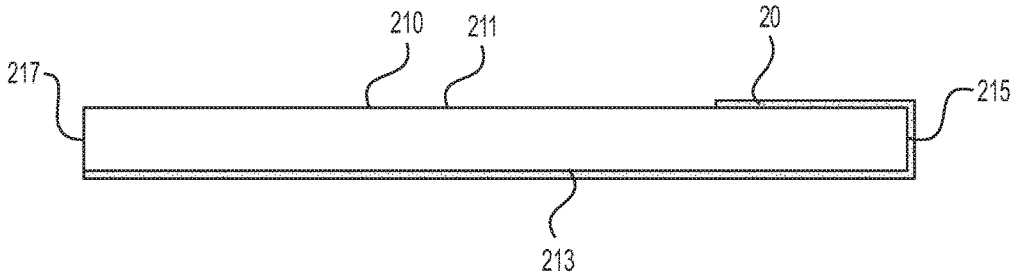
FIG. 6 is an assembled side view of the invention including the sanding pad and adhesive sanding material.

Referring to FIGS. 5-6, an abrasive material 20 may be adhered to the underside 213 of pad 210 or wrapped around the pad 210 as illustrated in FIG. 6, so that the material at least partially covers sides 213, 215, 211. This allows for easy replacement of the abrasive material. Many methods of adhering the abrasive material 20 may be appropriate, including securing the abrasive material 20 to the underside 211 of the pad 210, using Velcro® to secure a sheet of pre-prepared adhesive material to the pad, etc. It may be preferable, however, to secure a pressure-sensitive adhesive-coated abrasive material sheet 20 to the pad to prevent softening of the pad due to the Velcro® or the inability to replace the abrasive material. The expanded sheet PVC material may be such that the pressure-sensitive adhesive does not permanently adhere the abrasive material sheet 20 to the sanding pad 210.

Figure 7:
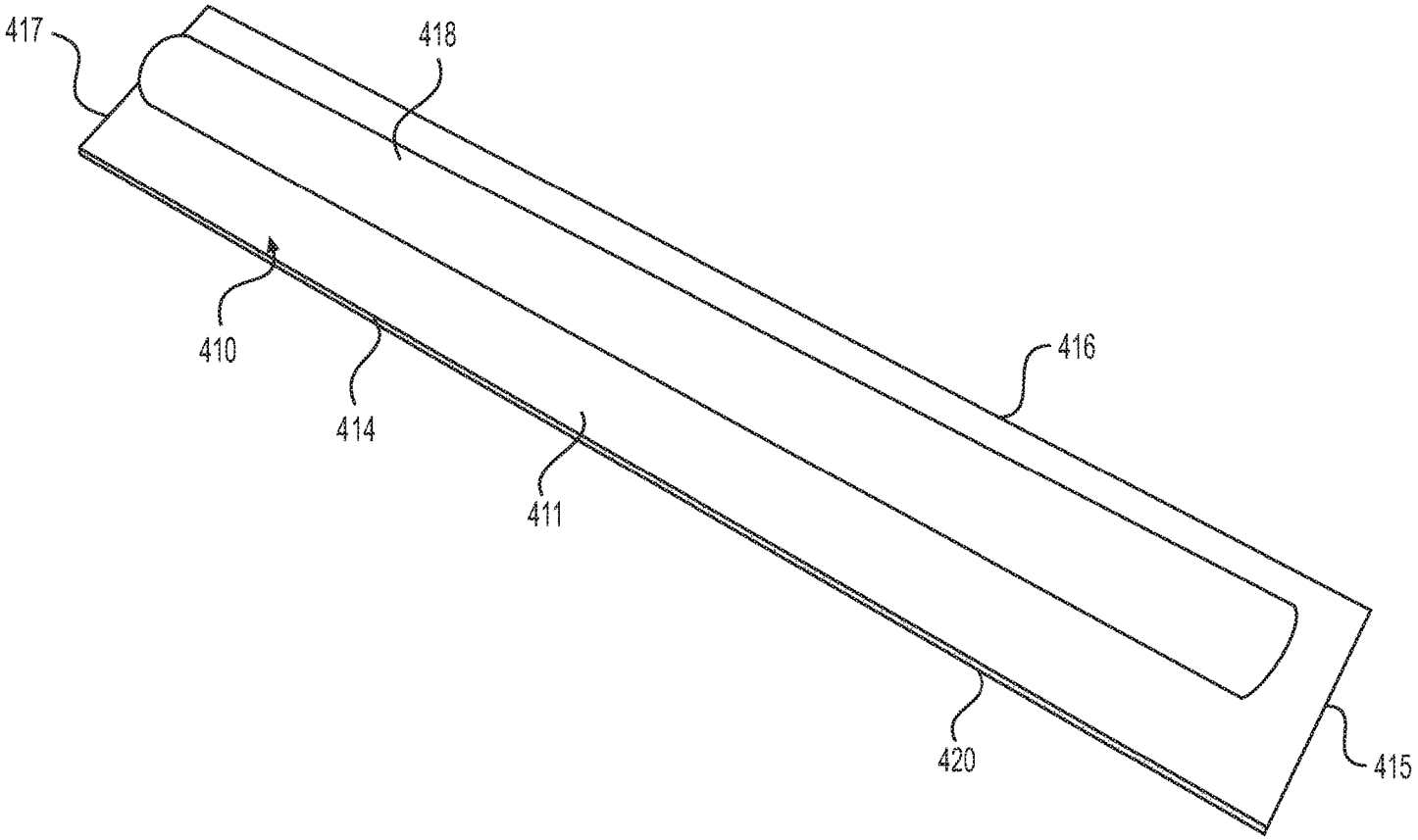
FIG. 7 is a top perspective view of the sanding pad of the invention in a fifth embodiment.
Figure 8:
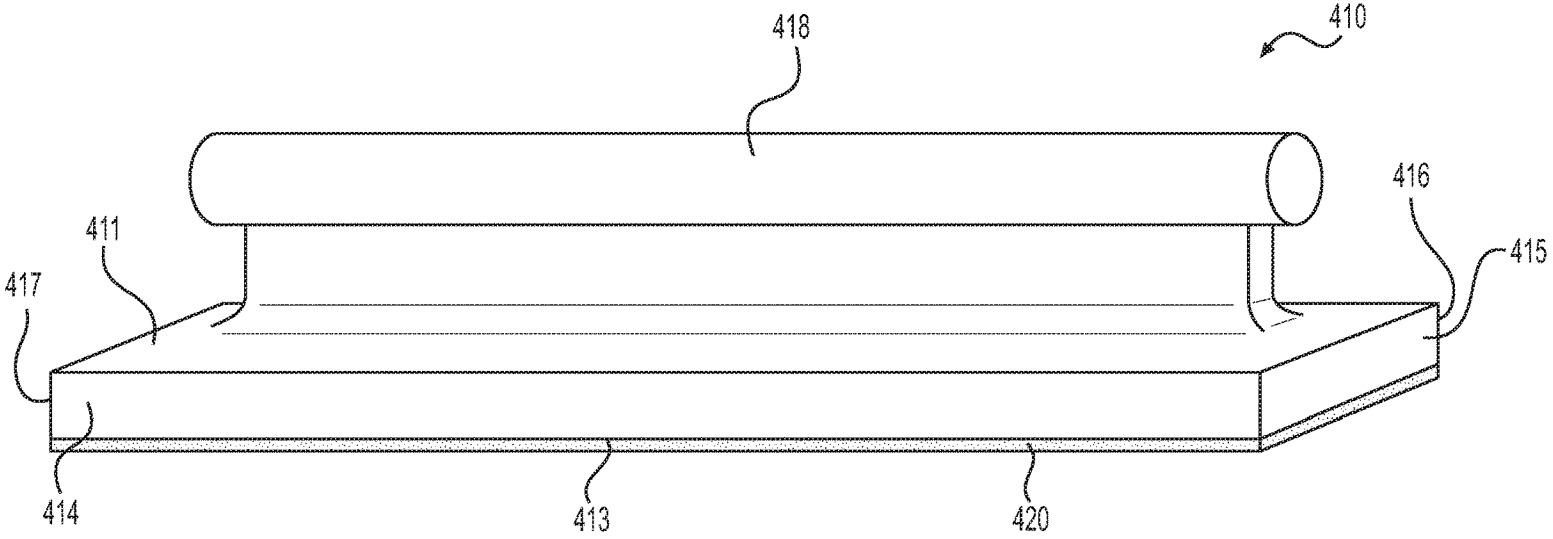
FIG. 8 is side perspective view of the sanding pad of the invention in the fifth embodiment in combination with an adhesive sanding material.

As illustrated in FIGS. 7-8, the illustrated sanding pad 410 is shown with an abrasive material 420. The sanding pad 410 may further include a handle 418 on one side 411, 413, 414, 415, 416, 417 of the pad 410 to allow for ease of operation of the pad 410. The handle 418 may take a variety of appropriate shapes and sizes, such as rectangular, triangular, hexagonal, et cetera, to allow a user to easily operate the sanding pad 410 and may be formed as one piece or attached in a variety of methods, such as adhesion, bonding, and glue. The handle 418 is shown as a hollow cylinder adhered to the top side 411 of the sanding pad 410 via a PVC bonding agent. Additionally, while the illustrated handle 418 is running substantially along the length of the pad 410, it is foreseen that the handle 418 could be any appropriate length, and further could be broken into multiple handles for ease of operation (e.g., one handle on each of two opposing ends of the top side 411 of the pad 410).

Further, the handle 418 may be formed of the same PVC material as the pad 410 itself, or alternately may be formed of a different material, so long as the handle 418 can be attached to the sanding pad 410. For example, the handle 418 may be made of a cloth or fabric adhered to opposing sides of the pads, allowing a user's hand to slide through the fabric to maintain a grasp on the pad 410.

A single sheet of expanded sheet PVC may be provided from which the different shapes and sizes of the pads 10, 110, 210, 310 may be procured. This may allow any number of shapes to be cut out of the expanded sheet PVC in order to meet the needs of the project with cut out dimensions less than 3 inches. For example, for a project with a small surface area, it may be appropriate to cut out a small square pad, while another project may require a pad having the shape of a triangle to get an edge into the tight corners. Any means of removing various shapes of sanding pads from a single sheet of expanded sheet PVC may be appropriate, including the use of table saws, band saws, CNC routers, punches, water jets, et cetera.

Each sanding pad 10, 110, 210, 310 after being removed from the sheet of expanded sheet PVC, may have its edges sanded to prevent blunt-force trauma to the product as a result of hard corners or edges on the sanding pad 10, 110, 210, 310.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention. Further, it will be understood that certain features and subcombinations may be of utility and may be employed within the scope of the disclosure. Further, various steps set forth herein may be carried out in orders that differ from those set forth herein without departing from the scope of the present methods. This description shall not be restricted to the above embodiments.

It is to be understood that while certain forms of the present invention have been illustrated and described herein, it is not to be limited to the specific forms or arrangement of parts described and shown.

What is claimed is as follows:

1. A sanding pad assembly for sanding a vehicle, comprising:

an abrasive material supported by a paper substrate; and a sanding pad having a top flat surface and an opposite flat bottom surface, the top and bottom surfaces are capable of providing attachment for the abrasive material and the sanding pad is formed of a material which has a Shore D durometer hardness value between 30 and 60.

2. The sanding pad assembly of claim 1, wherein the abrasive material is removable.

3. The sanding pad assembly of claim 1, wherein the abrasive material is wrapped about the sanding pad.

4. The sanding pad assembly of claim 1, wherein the abrasive material comprises a side that includes a pressure sensitive adhesive.

5. The sanding pad assembly of claim 1, further comprising a handle permanently attached to the top surface of the pad.

6. The sanding pad assembly of claim 1, wherein the sanding pad is adapted to be connected to a driving means.

7. The sanding pad assembly of claim 1, wherein the Shore D durometer hardness value is between 48 and 55.

8. The sanding pad assembly of claim 1, wherein the Shore D durometer hardness value is between 34 and 55.

9. The sanding pad assembly of claim 1, wherein the sanding pad is adapted to be connected to a tool.

10. The sanding pad assembly of claim 1, wherein the sanding pad is between ⅛ and ¼ inch thick.

11. A sanding tool kit containing a plurality of sanding tools for sanding a vehicle comprising:

a first rectangular shaped sanding pad;

a semi-circular sanding pad; and a circular sanding pad; and wherein each pad is formed of a material which has a Shore D durometer hardness value between 30 and 60; and wherein each pad is configured to receive an abrasive material supported by a paper substrate.

12. A sanding took kit of claim 11, further comprising a second rectangular shaped sanding pad, wherein a length of the second rectangular shaped sanding pad is greater than a length of the first rectangular shaped sanding pad.

13. The sanding kit of claim 11, wherein each pad is at least 1/32 inch thick, and each pad has one top flat surface and an opposite flat bottom surface; wherein:

the top and bottom surfaces are capable of providing attachment for an abrasive material.

14. The sanding kit of claim 11, wherein at least one pad has a thickness between ⅛ and ¼ inch.

15. The sanding kit of claim 11, wherein at least one pad has a Shore D durometer hardness value between 34 and 55.

16. The sanding kit of claim 11, wherein at least one pad has a Shore D durometer hardness value between 48 and 55.

17. A method of sanding a vehicle, the method comprising the steps of:

providing a vehicle in need of sanding;

providing a sanding pad having a top flat surface and an opposite flat bottom surface, the top and bottom surfaces, the sanding pad being formed of a material which has a Shore D durometer hardness value between 30 and 60;

placing an abrasive material supported by a paper substrate over at least one of the top flat surface and the opposite flat bottom surface; and sanding the outer surface with the combination of sanding pad and abrasive material.

* * * * *